United States Patent [19]

Hermann

[11] 4,008,119

[45] Feb. 15, 1977

[54] LABELLING DEVICE

[76] Inventor: Klaus Dieter Hermann, Klingenstrasse 13, 6932 Hirschhorn, Germany

[22] Filed: June 27, 1972

[21] Appl. No.: 266,709

[30] Foreign Application Priority Data

July 8, 1971 Germany ..... 2134074

[52] U.S. Cl. ..... 156/541; 156/577; 156/579; 156/584; 156/DIG. 48

[51] Int. Cl.[2] ..... B65C 11/00

[58] Field of Search ..... 156/577, 384, 584, 522, 156/523, 541, 579, DIG. 48; 221/73

[56] References Cited

UNITED STATES PATENTS

| | | | |
|---|---|---|---|
| 3,342,662 | 9/1967 | Grasmann | 156/522 X |
| 3,551,251 | 12/1970 | Sato et al. | 156/384 |
| 3,582,433 | 6/1971 | Rothenberger | 156/384 |
| 3,705,833 | 12/1972 | Wada | 156/577 X |

*Primary Examiner*—Charles E. Van Horn
*Assistant Examiner*—M. G. Wityshyn
*Attorney, Agent, or Firm*—Craig & Antonelli

[57] ABSTRACT

A hand-operated device for applying adhesive labels to an object to be labelled. The labels are carried on a backing strip which is moved intermittently around a deflecting edge such that a label is removed from the backing strip at each feed step. A pressure member serves to apply the label so removed to the object to be labelled and the pressure member and deflecting edge are mounted for movement about a fixed pivot during the feed. A pusher member mounted for movement about a fixed pivot transports the label from the deflecting edge to the pressure member while bearing against the adhesive face of the label.

14 Claims, 3 Drawing Figures

LABELLING DEVICE

The invention relates to a hand-operated device for applying adhesive labels arranged on a backing strip to an object to be labelled, the backing strip gradually being drawn around a deflecting edge by a drive mechanism, where at each feed step, a label is removed from the backing strip and placed under a pressure member of the device, with which member the label is stamped on the object, the pressure member and deflecting edge pivoting about a pin integral with the device, during the feed according to German Patent No. 1,924,023.

There are devices, in which the deflecting edge and the pressure member in the form of a rubber roller are fixedly mounted. In these known devices, the distance between the deflecting edge and the generatrix of the pressure roller operative upon application of pressure is smaller than the length of the label so that the label, when it is removed from the backing strip at the deflecting edge during the feed step, remains in the direction of the section of the backing strip located in front of the deflecting edge and, crossing the intermediate space, is applied to the under side of the pressure roller. However, this only occurs as long as the label's rear section, which sticks to the backing strip, is so large that the label keeps its direction and does not tilt downwards. In the so-called "distributing position" in which the label, after the feed step, is in readiness for being applied to the object to be labelled, this rear section with which the label sticks to the backing strip, must, therefore, on the one hand, be so large that the label does not tilt, but crosses the intermediate space and is applied to the under side of the pressure roller, but, on the other hand, must not exceed a predetermined size since otherwise the adhesive surface area is too large and the label can no longer be removed from the backing strip let alone reach the operative generatrix of the pressure roller, and therefore can no longer be stamped on the surface to be labelled. However, this requires that the feed step must take place exactly in a certain position with respect to the label on the backing strip, since if the label is moved forward in to the distributing position over its optimum position, its rear section sticking to the backing strip is too small and the label tilts; if the label is not moved far enough forward into the distributing position, the rear section of the label still sticking to the backing strip is too large and the above-mentioned disadvantages occur. The devices which are required for accurately maintaining the feed step in the required manner with regard to its length and position with respect to the label, however, considerably increase the production costs of such a device, therefore it has been taken into account that the rear end of the label sticks to the backing strip with a section which is so small it is already tilting and means have been provided which cause the front edge of the label, although the label is tilting and is no longer firmly connected to the backing strip, to be guided below the pressure roller. For this purpose, it is known from the Meto-devices to extend the front edge of the base of the device over the deflecting edge so that the tilting movement is delimited by this edge which was moved forward in a position in which the front end of the label still lies below the pressure roller. In the main patent, the distance between the deflecting edge and the operative point of the pressure member is greater than the length of the label so that the label in the distributing position does not stick to the backing strip with its rear end. Small clamping feet are located between the deflecting edge and the pressure member. The label, which is moved into the distributing position, when tilting rests on the small clamping feet, its rear end sticks, at the end of the feed motion, to the front end of the subsequent label by means of an adhesive link and the subsequent label pushes the label in the distributing position over the deflecting edge. The front end of the label then projects over the under side of the device and is drawn round under the pressure member when the device is placed on the object to be labelled. However if the adhesive link is not strong enough to maintain the connection between the two labels, the label moved into the distributing position also falls onto the small clamping feet and is removed therefrom when the device is placed on the surface to be labelled.

On the other hand it is known from a device of the firm SATO, when using a roll of labels in which the labels are spaced apart on the backing strip, to provide a pusher member which transports and guides the label on its way between the deflecting edge and pressure member. However, in this device the deflecting edge and the pressure member are again mounted integral with the device. The pusher member is displaceable in guideways by a complicated lever system. Due to the translation movement of the pusher device, this construction is however very expensive and susceptible to breakdowns.

The invention relates to a further development of the object of the main patent, in which the deflecting edge and the pressure member pivot about a pin integral with the device during the feed step. The invention consists in pivotably mounting the pusher member, known per se and transporting the label from the deflecting edge to the pressure member about a pin integral with the device and arranging this member so that it bears against the adhesive side of the label. Since the pivot pin of the part on which the deflecting edge and pressure member are mounted does not coincide with the pivot pin of the pusher member, the front end of the pusher member bearing against the label effects a relative movement with respect to the deflecting edge in the case of a movement approaching the pivot pin of the pusher member, during which relative movement it transports the label from the deflecting edge to the pressure member. The particular advantage of the invention is that the pusher member must effect no translation movement and therefore the arrangement is extraordinarily reliable to operate. Particularly if the pusher member is pressed resiliently in the direction of the adhesive side of the label, each former drive of the pusher member may be dispensed with so that any lever system is therefore dispensed with.

In devices in which the distance between the deflecting edge and the pressure member is smaller than the length of the labels, the arrangement according to the invention has the advantage that the pusher member leads the front end of the label safely to the pressure member, if the position of the feed step with respect to the label changes very little, since the pusher member prevents the label from tilting. In particular, the arrangement according to the invention has the advantage that in devices, in which the distance between the deflecting edge and the pressure member is greater than the length of the labels, the labels are transported safely from the deflecting edge to the pressure member, particularly in the case when labels of various lengths (seen in transport direction) are arranged on a backing strip. The label is received at the deflecting edge by the pusher member and transported to the pressure member, its length, which determines the point in time when the rear end of the label is released from the backing strip, being substantially complete for the safe transporting of the label. Also an essential advantage of the device according to the invention is that labels of various lengths can be discharged one after the other without re-arrangement which is not possible in any known device. For example, long and short labels may be arranged alternately on a backing strip, which are discharged one after the other without problems. In the same way, several short labels may follow each long label or vice versa. Only the position of the groups of labels is fixed for the feed step. The speed, with which the front end of the pusher member moves on its way between deflecting edge and the pressure member, in strips of labels in which the labels are spaced apart on the backing strip, may be smaller than, equal to or larger than the feed velocity of the backing strip. In strips of labels in which the labels are arranged next to each other on the backing strip, this velocity should be the same as or larger than the feed velocity. Since the speed with which the front end of the pusher member moves between the deflecting edge and the pressure member is generated by the pivoting movement of two adjacent parts about different pins, the movement of the front end of the pusher member is not usually a uniform movement but a movement with acceleration or deceleration. It is also unnecessary for the front end of the pusher member to move over the entire region between the deflecting edge and pressure member, its movement may be limited to a parital section within this region. The pivoting movement of the pusher member occurring against as in the direction of the action of the spring, may be restricted by stops bearing against the pusher member. In another embodiment of the invention a deflector is arranged on the side of the label facing the pusher member, which deflector extends over at least one part of the distance between the deflecting edge and the pressure member. During the feed motion, due to the force of the spring pressing against it, the front end of the pusher member presses the label against the deflector and pushes it along the deflector to the pressure member. The deflector may also be formed by one part of the pressure member.

It has already been mentioned above that with the arrangement according to the invention, labels of various lengths may be employed. Labels of various lengths may be employed alternately, if a label of greater length and a label of smaller length are arranged alternately one after the other on the backing strip, and if the total length of the two successive labels is equal to the sum of two feed steps, since the length of the feed step, in known devices, may be unchanged or only slightly changed. If labels of only a certain length are located on a strip of labels, labels may be used whose length coincides with the feed step of the device, the labels are then secured on the backing strip with no intermediate space. If labels are used, whose length is smaller than the feed step, the labels are then spaced apart on the backing strip. In both cases, it may be advantageous if the position of the feed step with respect to the labels may be adjusted. This is achieved in one feature of the invention in that there is located between the deflecting edge and a drive mechanism seen in the direction in which the strip moves and located behind it a part movable at right angles to the path of the empty backing strip for adjusting the length of the path. Due to this, the position of the feed step, when all lengths of labels are used, is always such that at the end of the feed step, the rear section of the label, provided that it is mainly still sticking to the backing strip, is so small that the pusher member may pull the label from the backing strip.

Since the end of the pusher member facing the pivot pin bears against the adhesive side of the label, it is advantageous if, in one embodiment of the invention, the pusher member has at its end projections intended to bear against the label, so that the end of the pusher member does not bear against the adhesive face with its entire edge. Thus, in one embodiment of the invention, the labels can be formed such that their adhesive face is made to be non-adhesive at those points against which the projections bear, for example in that mainly at these points no adhesive is applied or in that the adhesive layer is covered by a strip of paper or the like at these points.

In embodiments of the invention, the pivot pin of the pusher member may be adjusted or secured in elongated slots. By changing the position of the pivot pin of the pusher member the path and speed variation of the movement of the pusher member may be changed and adjusted to the length of the labels, provided that such an adjustment is necessary. As long as pusher member and feed have approximately the same velocity, it is unnecessary that, at the moment when the front end of the pusher member bears against the label, the label is moved forward so far that the pusher member can completely remove the label from the backing strip. On the other hand, the section of the label which is in front of the point against which the pusher member bears, must be so large that in the end position of the movement of the pusher member the front section of the label is under the pressure member or at least projects from the under side of the device so far that it lies under the pressure member due to the retracting movement occurring when the device is placed on the object to be labelled.

The invention will be further described by way of example only with reference to the accompanying drawings, in which.

Figure 1:
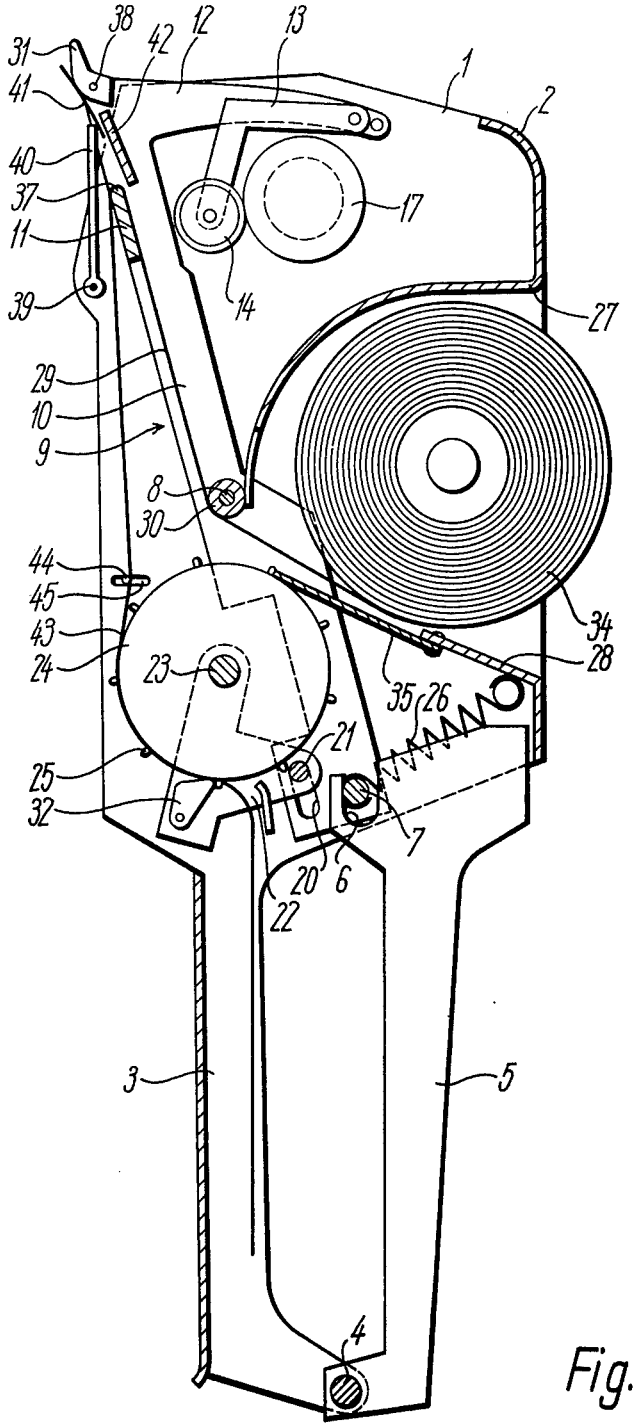
FIG. 1 shows the essential parts of one embodiment of the invention, in the rest position.

In the embodiment of the invention shown in the drawing, the casing consists essentially of two parallel plates 1 which are kept in spaced apart relationship by panels 2 and studs. A hollow handle 3 is provided at the rear end of the housing. An operating lever 5 is connected to a pin 4 at the rear end of the handle 3, which lever engages in the space between the two side walls 1, and has at this end an elongated slot 6 open at the edge, in which slot a pin 7 is guided. A rocker member 9 is pivotably mounted about a pin 8 secured in the side walls 1, which rocker member consists of two spaced apart stamped parts 10 which are interconnected by pins 7 and a pressure plate 11 and other smaller parts. The distance between these two stamped parts is slightly greater than the widest strip of labels employed in the device. The parts 10 each have an upwardly projecting arm 12 at the end of the rocker member remote from the lever 5 and each arm 12 is connected at its distal end to a cranked lever 13. The free ends of the two levers 13 carry between them an ink roller 14 which is used for inking a printing mechanism 17.

There is provided at the end of the rocker member 9 adjacent the lever 5 an elongated slot 20 in which is guided a pin 21 secured to an angled element 22. This element 22 also consists of two flat stamped parts spaced apart. The element 22 is pivotably mounted about a pin 23 integral with the casing, and supports a pawl 32. A transport wheel 24 is rotatably mounted on the pin 23 between the two plate-like parts of the element 22. The transport wheel 24 has radially projecting pins 25.

A spring 26 holds the rocker member 9 in the position shown in FIG. 1. A strip of labels in the form of a roll 34 is inserted in the device and is removably mounted in bearings (not shown) in the two side walls 1. Divider plates 27 and 28 define the space intended for receiving the roll 34. The strip of labels 29 has a backing strip on which rectangular labels are detachably arranged next to each other. It passes around a roller 30 pivotably mounted about the pin 8 to the deflecting edge 37 at the front end of the pressure plate 11 and from there to the periphery of the transport wheel 24. On its centre line it has perforations in which the radial pins 25 of the transport wheel 24 engage.

At the front end of the rocker arm 9, which in the rest position projects downwards from the casing, a cam 31 made of resilient material is pivotal on a pin 38 against the action of a spring.

In the casing of the device a roller 44 is adjustably and fixably arranged in an elongated slot 45, over which roller the empty backing strip is guided on the section between the deflecting edge 37 and the transport wheel 24. The elongated slot 45 runs transversely to the direction of the strip. By adjusting the roller 44 the length of the path of the strip section between the deflecting edge 37 and the transport roller 24 and therefore the feed step with respect to the deflecting edge 37 may be adjusted.

The distance between the deflecting edge 37 and the operative line of the cam 31 acting as pressure member is greater than the length of a label. Beneath the pressure plate 11, a pusher member 40 is pivotably mounted about a pin 39 fixed on the casing and is acted upon by a spring urging the pusher member 40 in a clock-wise direction. In the position shown in FIG. 1, the front end of the pusher member 40 bears against the under side of a label 41 to hold the label 41 against a deflector 42 which is located in the region between the deflecting edge 37 and the cam 31.

Figure 2:
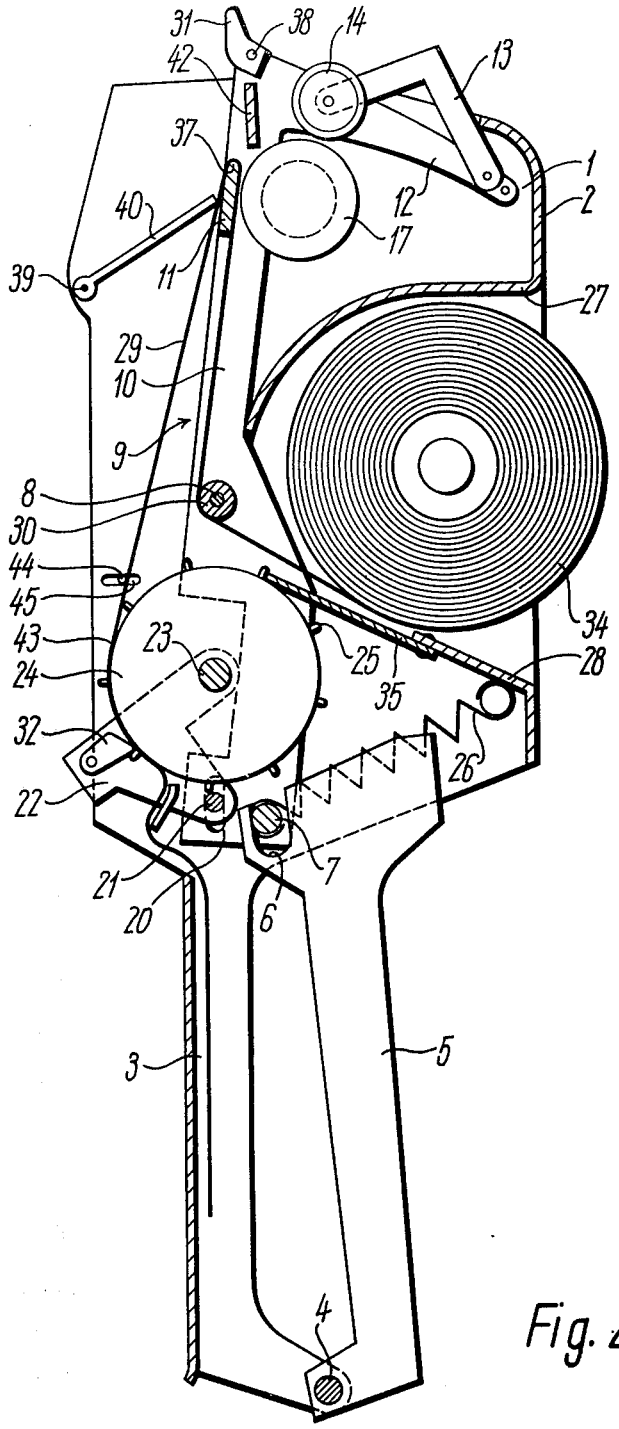
FIG. 2 shows these parts when the operating lever has been pressed.

If the lever 5 is pressed downwards, the rocker member 9 is moved around the pin 8 in the clockwise direction and the angle element 22 is also moved in the clockwise direction. Thus the pawl 32 passes over the next radial pin 25. A resilient locking plate 35 locks the transport wheel 24 at the time of this movement. At the same time the inking roller 14 is rolled over the printing type and is moved into a position adjacent the printing mechanism 17. The roller 30, the deflecting edge 37 and the point 43 where the strip of labels reaches the periphery of the transport wheel 24, form a triangle along two sides of which the strip of labels 29 is guided. When the rocker member moves in clockwise direction about the pin 8, the points 8 and 43 form a steady base for the triangle, whereas the deflecting edge 37 is moved upwards whereby the distance between the deflecting edge 37 and the point 43 is increased and thus the loop of the strip of labels formed between the pin 8, the deflecting edge 37 and the point 43 is larger. In this way, in the end position of this movement shown in FIG. 2, there is pulled from the roll 34 a length of strip which roughly corresponds to half of the feed step, without the transport wheel 24 being moved. In this end position shown in FIG. 2, a label located on the pressure plate 11 is imprinted by the printing type of the stationary printing mechanism 17. In this position, the pusher member 40 bears against the deflecting edge 37. If the lever 5 is released, the spring 26 moves the rocker member counter-clockwise back to its starting position. Thus, the pawl 32 engages behind the next radial pin 25 and moves the transport wheel 24 one step further. When the rocker member 9 has moved back, the front end of the pusher member 40 bears against the adhesive face of the label 41, which is removed from the backing strip when the latter is moved round the deflecting edge 37. As the rocker arm 9 moves in counter clockwise direction from the front end of the pusher member 40, which, in the illustrated embodiment, bears against the label in the centre or just behind the centre, the label is pushed along the deflector 42 to the cam 31, so that the front end of the label is stamped onto the object to be labelled when the device is placed on the latter. When the device is retracted, the cam 31 slides over the entire height of the label and the latter is stamped on the object.

The pusher member 40 does not bear against the adhesive side of the label 41 with its whole front end edge but has on its front end two or three projections, for example, dovetail projections, with which it bears against the label. One of these projections is on the perforated centre line of the strip of labels. The adhesive labels have no adhesive in the region of this centre line so that a projection of the pusher member 40 bearing thereagainst does not come into contact with the adhesive. In other strips of labels, those longitudinal strips against which other projections of the pusher member 40 bear, can be kept free of adhesive. In this way, no adhesive can accumulate on the pusher member.

What is claimed is:

1. Labelling device comprising:

label supply means for supplying a backing strip with a plurality of adhesive labels attached thereto, deflecting edge means for separating the labels from the backing strip in response to movement of the backing strip therearound, a pressure member spaced from the deflecting edge means in the direction of movement of the labels, said pressure member being engageable with a separated label which has been separated from the backing strip for pressing said separated label against an object to be labelled, and pusher member means engageable with the side of said separated label which was in contact with the backing strip for aiding in guiding and moving said separated label away from the deflecting edge means and into engagement with said pressure member.

2. Device according to claim 1, wherein resilient means are provided for resiliently forcing the pusher member in a direction towards the separated label.

3. Device according to claim 2, wherein said pusher member is mounted for pivotal movement about a fixed pusher member pivot means, said fixed member pivot means being disposed opposite the end of the pusher member which is engageable with said separated label.

4. Device according to claim 1, wherein the deflecting edge means and the portion of the pressure member which engages said separated label are spaced a predetermined distance from one another which is greater than the length of the smallest label intended to be applied by the device.

5. Device according to claim 1, wherein a deflector is provided which is disposed on the side of the separated label opposite said pusher member and which extends over at least a portion of the space between the deflecting edge means and the pressure member, said deflector including a guide surface portion which is engageable with said separated label over at least a portion of the travel path of the separated label between the deflector edge means and the pressure member.

6. Device according to claim 1, wherein a drive means is positioned downstream of the deflector edge means for engaging with and forcibly pulling said backing strip around said deflector edge means, and wherein feed step adjusting means are interposed between said deflector edge means and said drive means, said feed step adjusting means including means engageable directly with said backing strip to vary the length of the travel path of said backing strip from said deflector edge means to said drive means.

7. Device according to claim 1, wherein the pusher member includes projections for directly engaging said separated label.

8. Device according to claim 1, wherein moving means are provided for intermittently moving said backing strip along a path around said deflecting edge means.

9. Device according to claim 8, wherein said moving means includes manually actuatable handle means.

10. Device according to claim 9, wherein the deflecting edge means and the portion of the pressure member which engages said separated label are spaced a predetermined distance from one another which is greater than the length of the smallest label intended to be applied by the device.

11. Device according to claim 8, wherein said pressure member and said deflecting edge means are mounted on a rocker member, said rocker member being movable about a fixed rocker pivot means which is spaced from both of said pressure member and deflection edge means during actuation of said moving means, and wherein said pusher member is pivotally mounted at a pusher member pivot means, said pusher member pivot means being movable with a handle member, which handle member is movable with respect to said rocker member during actuation of said moving means.

12. Device according to claim 11, wherein said moving means includes means responsive to forcing of said handle means toward an operating lever, said operating lever being engageable with said rocker member for pivoting said rocker member.

13. Device according to claim 12, wherein said handle means and operating lever are configured and dimensioned for accommodating one hand manual movement thereof with respect to one another.

14. Device according to claim 1, wherein said pusher member includes projection means for engaging said separated label only at predetermined portions not including adhesive thereon.

* * * * *